US011679516B2

(12) United States Patent
Gallegos

(10) Patent No.: US 11,679,516 B2
(45) Date of Patent: Jun. 20, 2023

(54) SLIM PEN CUTTER

(71) Applicant: Slice, Inc., San Jose, CA (US)

(72) Inventor: Robert Joseph Gallegos, Fremont, CA (US)

(73) Assignee: Slice, Inc., Sunny Isles, FL (US)

( * ) Notice: Subject to any disclaimer, the term of this patent is extended or adjusted under 35 U.S.C. 154(b) by 43 days.

(21) Appl. No.: 17/243,808

(22) Filed: Apr. 29, 2021

(65) Prior Publication Data

US 2022/0347869 A1 Nov. 3, 2022

(51) Int. Cl.
*B26B 1/08* (2006.01)

(52) U.S. Cl.
CPC ..... *B26B 1/08* (2013.01)

(58) Field of Classification Search
CPC ..... B26B 1/00; B26B 1/08
USPC ..... 30/162
See application file for complete search history.

(56) References Cited

U.S. PATENT DOCUMENTS 5,319,853 A * 6/1994 Schmidt ..... B26B 5/001 30/169
2019/0193289 A1* 6/2019 Scimone ..... B26B 5/001

FOREIGN PATENT DOCUMENTS

WO WO-2017057468 A1 * 4/2017 ..... B26B 1/08

* cited by examiner

*Primary Examiner* — Nhat Chieu Q Do
(74) *Attorney, Agent, or Firm* — McCarter & English, LLP; James Smedley; Alex Korona

(57) ABSTRACT

The present invention relates to a cutting device, and more particularly to a cutting device having a selectively replaceable and reorientable blade. The cutting device has a housing and a carriage that is movably disposed in the housing, the carriage being movable between a retracted position and an extended position. The cutting device also has a cutting member that is removably disposable and reorientable in the carriage and a cover member that is removably attachable to the housing.

14 Claims, 4 Drawing Sheets

SLIM PEN CUTTER

TECHNICAL FIELD

The present disclosure generally relates to a cutting device, and more particularly to a cutting device having a selectively replaceable and reorientable blade.

BACKGROUND

Replacing or reorienting blades in conventional cutting tools such as, for example, utility cutters, can often be difficult and unsafe. For example, a user may struggle with safely removing an old blade and replacing that old blade with a new, sharp blade. Also, for example, a user may not be able to easily reorient a blade in a cutting tool, for example, without the use of additional tools, to adjust the cutting tool such that it is compatible for both left-handed and right-handed users (e.g. ambidextrous). Therefore, there is a need in the art for a pen cutter that incorporates a means for reorienting or replacing a blade, and improved handle ergonomics. These and other features and advantages of the present invention will be explained and will become obvious to one skilled in the art through the summary of the invention that follows.

SUMMARY OF THE DISCLOSURE

In one exemplary aspect, the present disclosure is directed to a cutting device. The cutting device may includes a housing and a carriage that is movably disposed in the housing, the carriage being movable between a retracted position and an extended position. The cutting device may also include a cutting member that is removably disposable in the carriage and a blade cover member that is removably attachable to the housing.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED DESCRIPTION

Figure 1:
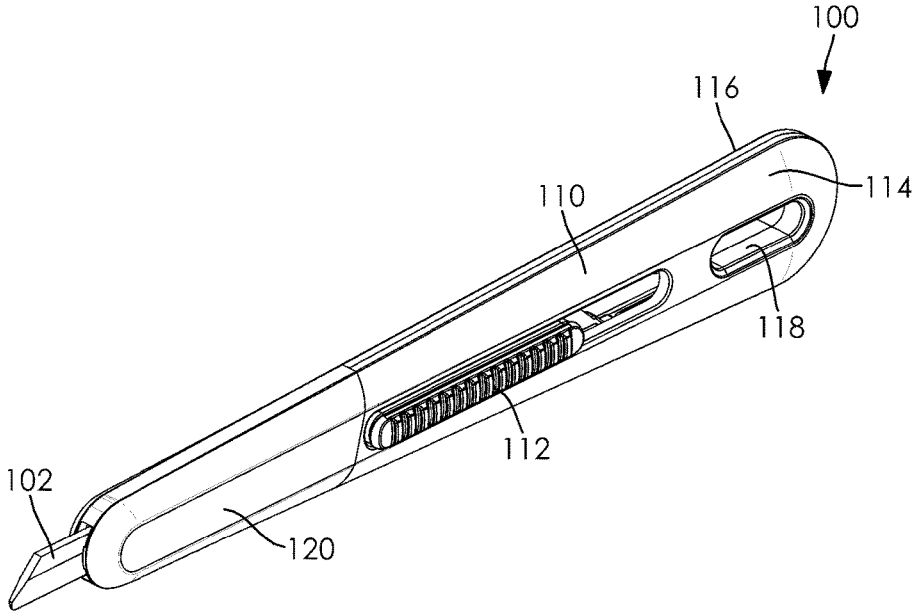
FIG. 1 is a perspective view of an exemplary cutting device with an extended blade in accordance with an embodiment of the present invention.

The present invention generally relates to a cutting device. Specifically, embodiments of the present invention relate to a pen cutter apparatus with a retractable blade. Embodiments of the pen cutter apparatus may further comprise a housing with a blade carriage movably disposed therein.

In accordance with embodiments of the present invention, a pen cutter apparatus may comprise a main body housing, a blade, a blade carriage, and a blade cover member having a blade outlet slot. Certain embodiments of the present invention may include fewer components or additional components depending on the utilization and purpose for the pen cutter.

In accordance with embodiments of the present invention, the main body housing of the pen cutter apparatus may be configured to receive and retain a blade, a blade carriage, and a tension component. In some embodiments, the main body housing may be comprised of two corresponding halves, a front-half body shell and a rear-half body shell, that may be configured to contain the other components of the pen cutter. In some embodiments, the main body housing may be substantially slim and elongate and configured to permit deft movement while cutting. In some embodiments, the main body housing may comprise housing engagement members configured to align and connect the front-half body shell with the rear-half body shell. In some embodiments, the main body housing may include an opening at a top portion of the pen cutter, for example, an opening configured to receive or connect with a keychain, hook, carabiner, clasp, lanyard, or other similarly suitable connector members. One of ordinary skill in the art would appreciate that the main body housing could be designed in any number of configurations, and embodiments of the present invention are contemplated for use with any such configuration.

In accordance with embodiments of the present invention, the main body housing may provide, for example, a handle for use by a user. For example, the main body housing may be configured as a handle of a pen cutter, a seam ripper, a box cutter, utility knife, or precision knife. In some examples, the main body housing may be a substantially hollow housing configured to receive and retain a blade carriage as well as additional components such as the exemplary components described herein. In some scenarios, the main body housing may be an elongate housing that tapers from a first side to a second side of the housing. In some examples, the main body housing may be any suitable shape such as, for example, a substantially regular tube shape, e.g., a square, triangular, hexagonal, and/or octagonal shape.

In accordance with embodiments of the present invention, the main body housing of the pen cutter may comprise a front-half body shell. The front-half body shell may comprise some or all of the following: an opening, a blade carriage outlet slot, a blade carriage track outlet slot, one or more housing connector members, one or more blade cover connector components, and one or more carriage track connector components. The blade carriage outlet slot may be an indentation formed at a side portion of the front-half body shell that may be configured to receive at least a portion of the blade carriage and may create a passage to an internal portion of the pen cutter. In some embodiments, the blade carriage track may define a path for the movement of the blade carriage within the main body housing. One of ordinary skill in the art would appreciate that are numerous suitable configurations for the front-half body shell of the pen cutter, and embodiments of the present invention are contemplated for use with any such configuration.

In accordance with embodiments of the present invention, the main body housing of the pen cutter may comprise a rear-half body shell. The rear-half body shell may comprise some or all of the following: an opening, a blade carriage outlet slot, a blade carriage track outlet slot, a switch member slot, one or more housing connector members, and one or more blade cover connector components. The blade carriage outlet slot may be an indentation formed at a side portion of the rear-half body shell that may be configured to receive at least a portion of the blade carriage and may create a passage to the internal portion of the pen cutter. In some embodiments, the blade carriage track may define a path for the movement of the blade carriage within the main body housing. One of ordinary skill in the art would appreciate that are numerous suitable configurations for the rear-half body shell of the pen cutter, and embodiments of the present invention are contemplated for use with any such configuration.

In accordance with embodiments of the present invention, the main body housing may include a front housing engagement means and a rear housing engagement means. The front housing engagement means may comprise one or more housing connector elements configured along the edge of the front-half body shell and corresponding connector elements on the rear-half body shell, that are adapted to connect and align the front-half body shell to the rear-half body shell. For example, the engagement means may comprise hollow channels disposed on the front-half body shell and adapted to engage with corresponding protrusions on the rear-half body shell. One of ordinary skill in the art would appreciate that the each of the housing engagement could be adapted with a number of designs, and embodiments of the present invention are contemplated for use with any suitable design.

In accordance with embodiments of the present invention, the pen cutter may include a cutting assembly. The cutting assembly may comprise a blade carriage, a blade, a blade channel and a switch member and may be configured to move forward and backward within the main body housing. The cutting assembly may be configured to extend and retract to move the blade, for example, to extend or retract the blade out of or into the main body housing, as desired by a user. The blade carriage may be engaged with a switch member which may be configured to control the retraction and extension of the blade carriage and the blade disposed in the blade channel. In some examples, the cutting assembly may be configured to manually or automatically retract. For example, the switch member of a manually retractable cutting device may include one or more tap configured to engage with corresponding slots in the blade carriage track to selectively lock the blade carriage (and a blade disposed therein) in a user-selected position of available pre-selected blade positions defined by the positions of the one or more slots in the blade carriage track. Also for example, in a automatically retractable cutting device, the blade carriage may operably connected to a tension component, for example, a spring, configured to bias the blade carriage towards the retracted blade carriage position such that after the forward force is exerted on the blade carriage to extend the blade in the blade carriage out of the blade outlet slot is released, the blade carriage automatically returns to the retracted position as a result of the biasing force of the tension component. One of ordinary skill in the art would appreciate that there are many suitable designs for a cutting assembly, and embodiments of the present invention are contemplated for use with any such design.

In accordance with embodiments of the present invention, the cutting assembly may comprise a blade carriage. The blade carriage may be configured with a spine or top side and a "belly" or bottom side and may be configured to releasably or removably retain a blade. The blade carriage may be configured with one or more wall portions configured to slidably engage with the blade carriage track to enable the blade carriage (and a blade disposed thereon) to move from a selection of retracted and extended positions. One of ordinary skill in the art would appreciate that there are many suitable designs for a blade carriage, and embodiments of the present invention are contemplated for use with any such design.

In accordance with embodiments of the present invention, the blade carriage may comprise a blade channel. The blade channel may be configured to releasably retain the blade in one of many available positions. For example, the blade channel may retain the front or rear tip of the blade nearest the blade outlet slot when the blade carriage is in the retracted position. Also for example, the blade channel may retain the blade with the spine of the blade corresponding or aligned with the spine of the blade carriage, or may be flipped, such that the spine of the blade corresponds or aligns with the belly or bottom side of the blade carriage. The blade channel may be configured with one or more locking members, for example, protruding members which may each include one or more indented portions and one or more tab implements. The locking members may be configured to correspond with a notch in the blade to assist in retaining the blade within the blade channel. The indented portions in the locking members may be configured to receive the cutting edge of the blade.

In accordance with embodiments of the present invention, the cutting assembly may comprise a blade carriage track. The blade carriage track may be disposed between the rear-half body shell and the blade carriage. The blade carriage track may include a blade carriage channel. The blade carriage channel may be a void formed in the blade carriage track that creates a passage for blade carriage to move from a first position to a second position. The blade carriage channel may define the movement boundary of the blade carriage and may include one or more locking elements, for example, one or more slots (e.g., a pair of slots substantially opposing one another) that are disposed along the blade carriage channel configured to stabilize and secure the switch member in a user selected position of a set of preselected positions. In some examples, one or more tab members extending from switch member may be configured to correspond to the size and orientation of one or more of slots in the blade carriage channel such that when the tab members of the switch member rest within the slots, the switch member, and the blade carriage operably connected thereto, are reversibly and securely locked in the position corresponding to the position of the slots. One of ordinary skill in art would appreciate that there are numerous types and configurations for a blade carriage track, and embodiments of the present invention are contemplated for use with any such blade carriage track.

In accordance with embodiments of the present invention, the main body housing may comprise a switch member. The switch member may comprise one or more locking tabs configured to correspond to and releasably lock in one of a selection of positions defined by slots disposed on the blade carriage track. The top of the switch member may be grooved to improve grip between the switch member and the thumb of a user. A bottom side of the switch member may comprise one or more tension components, for example, one or more springs and/or tension springs, configured to bias the switch member upwards, towards the aperture formed in the front-half body shell, and to bias the tabs of the switch member towards the one or more slots formed in the blade carriage track to lock the switch member in the position defined by the position of the slots in the blade carriage track. In some examples, when the switch member is pressed, and the tension components below the switch member are compressed, the locking tabs may be released or unlocked from the slots along the blade carriage track such that the blade carriage may be extended or retracted out of or into the main body housing, as selected by a user. The switch member may engage or connect with the blade carriage, the blade carriage configured to engage with the blade carriage track in a manner that allows the blade carriage to be aligned to slide forward and backward within the main body housing. One of ordinary skill in the art would appreciate that there are many suitable designs for a switch member, and embodiments of the present invention are contemplated for use with any such design.

In accordance with embodiments of the present invention, the cutting assembly may comprise a tension component. The tension component, for example, a spring, may be disposed between the blade carriage and an internal wall of the main body housing. The tension component may be configured to bias the blade carriage towards the retracted position such that the blade disposed in the blade channel may be biased towards the interior of the main body housing. In some scenarios, if a force, for example, a forward force, greater than the biasing force applied by the tension component is applied to the switch member connected to the blade carriage, the blade carriage may move forward such that the blade disposed in the blade channel may extend past the blade outlet slot in the blade cover member. Moreover, if a force is not applied the switch member or the blade carriage (or the force applied to the blade carriage is lower than the biasing force applied by the tension component), the tension component may direct the blade carriage to automatically retract to return the blade to its retracted position. One of ordinary skill in the art would appreciate that there are many suitable designs for a tension component, and embodiments of the present invention are contemplated for use with any such design.

In accordance with embodiments of the present invention, a blade may be disposed within the pen cutter. The blade may be permanent or exchangeable, and may be secured in the blade holder by any suitable means, including one or more of numerous fasters such as rivets, bolts and screws, friction fit, adhesives, and combinations thereof. For example, the blade channel of the blade carriage may be configured to provide a friction fit by its tight-fitting structure. Moreover, the blade may be configured with a notch to be permanently or releasably secured by a corresponding structure in the blade channel. The blade may be configured with a spine and a cutting edge on opposite sides of its width, and a front tip and a rear tip on opposite sides of its length. In some scenarios, the blade may be releasably secured to the blade channel in one of many available positions, for example, the blade may be disposed in the blade channel with the front or rear tip of the blade nearest the blade outlet slot. Also for example, the blade may be disposed in the blade channel with the spine of the blade corresponding to the spine of the blade channel, or may be flipped, such that the spine of the blade corresponds to the belly side of the blade channel. In any embodiment, the blade may be made from any suitable material, including, but not limited to, metal, ceramic, or any combination thereof. One of ordinary skill in the art would appreciate that there are numerous configurations and materials that might be used for the blade, and embodiments of the present invention are contemplated for use with any such material or configuration.

In accordance with embodiments of the present invention, the blade that is used may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention.

In accordance with embodiments of the present invention, the main body housing may include an opening at a top portion of the pen cutter. The opening may be, for example, an opening configured to receive or connect with a keychain, hook, carabiner, clasp, lanyard, or other similarly suitable connector members. In some embodiments, one or more apertures in the edges of each of the front-half body shell and rear-half body shell collectively form the opening when the two body shells are connected together. One of ordinary skill in the art would appreciate that there are many suitable designs for an opening and embodiments of the present invention are contemplated for use with any such design.

According to an embodiment of the present invention, the blades used in the pocket cutter may contain rounded tips to reduce the chance of injury.

Turning now to the figures, FIG. 1 depicts a perspective view of an exemplary cutting device with an extended blade in accordance with an embodiment of the present invention. As shown in FIG. 1, the cutting device 100 may include a main body housing 110, a blade 102, a switch member 112, and a cover member 120. The housing may comprise a front-half body shell 114, and a rear-half body shell 116. The housing 110 may include an opening 118 which may help facilitate a storage and/or carrying method for cutting device 100. For example, the opening 118 may be configured to receive a keychain, hook, carabiner, clasp, lanyard, or other similarly suitable connector members. The cover member 120 may be removably attachable to housing 110, for example, at a portion of the housing 110 where the front-half body shell 114 and the rear-half body shell 116 connect.

Figure 2:
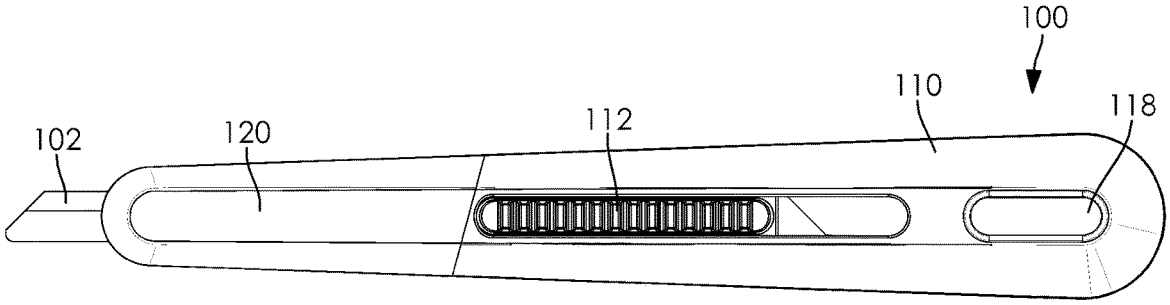
FIG. 2 is a front view of an exemplary cutting device with an extended blade in accordance with an embodiment of the present invention.
Figure 3:
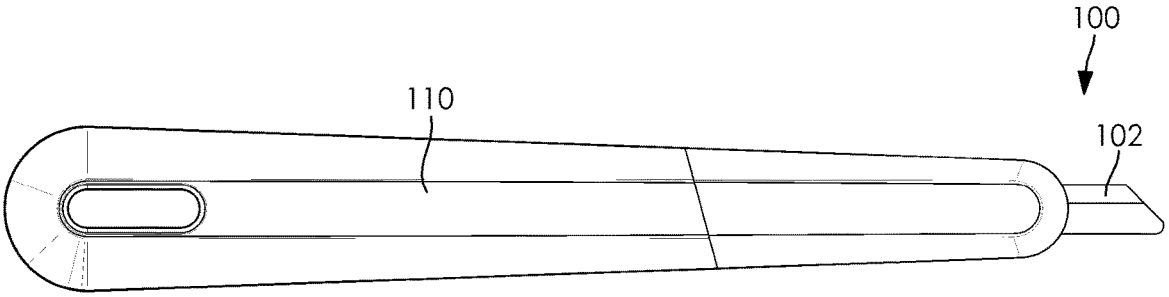
FIG. 3 is a rear view of an exemplary cutting device with an extended blade in accordance with an embodiment of the present invention.

FIGS. 2 and 3 respectively depict front and rear views of an exemplary cutting device with an extended blade in accordance with an embodiment of the present invention. As shown in FIGS. 2 and 3, the cutting device 100 may comprise a housing 110, a blade 102, a switch member 112, and a cover member 120.

Figure 4:
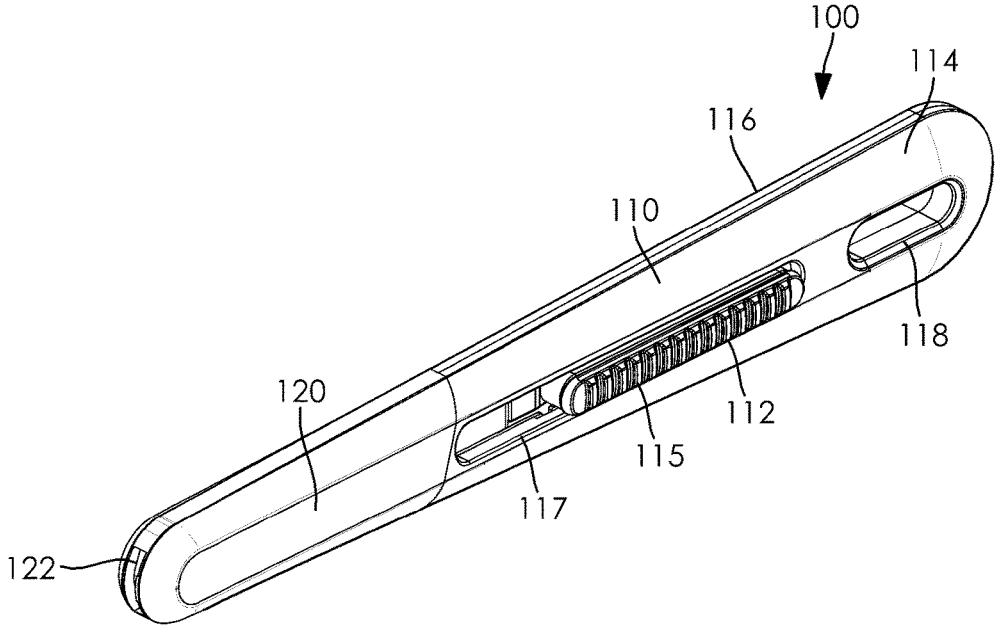
FIG. 4 is a perspective view of an exemplary cutting device with a retracted blade in accordance with an embodiment of the present invention.

FIG. 4 depicts a perspective view of an exemplary cutting device with a retracted blade in accordance with an embodiment of the present invention. As shown in FIG. 4, the cover member 120 may connect to the housing 110. The housing 110 may include an aperture 117 formed on a portion of the front-half body shell 114 of housing 110, for example, a wall portion of front-half body shell 114, such as an exterior wall portion. The aperture 117 may receive a portion of cutting assembly 115. For example, the aperture 117 may be an elongated aperture that movably receives a portion of cutting assembly 115. For example, aperture 117 may be an elongated aperture (e.g., an elongated groove) along which a portion of cutting assembly 115, for example, a switch member 112 may be moved.

Figure 5:
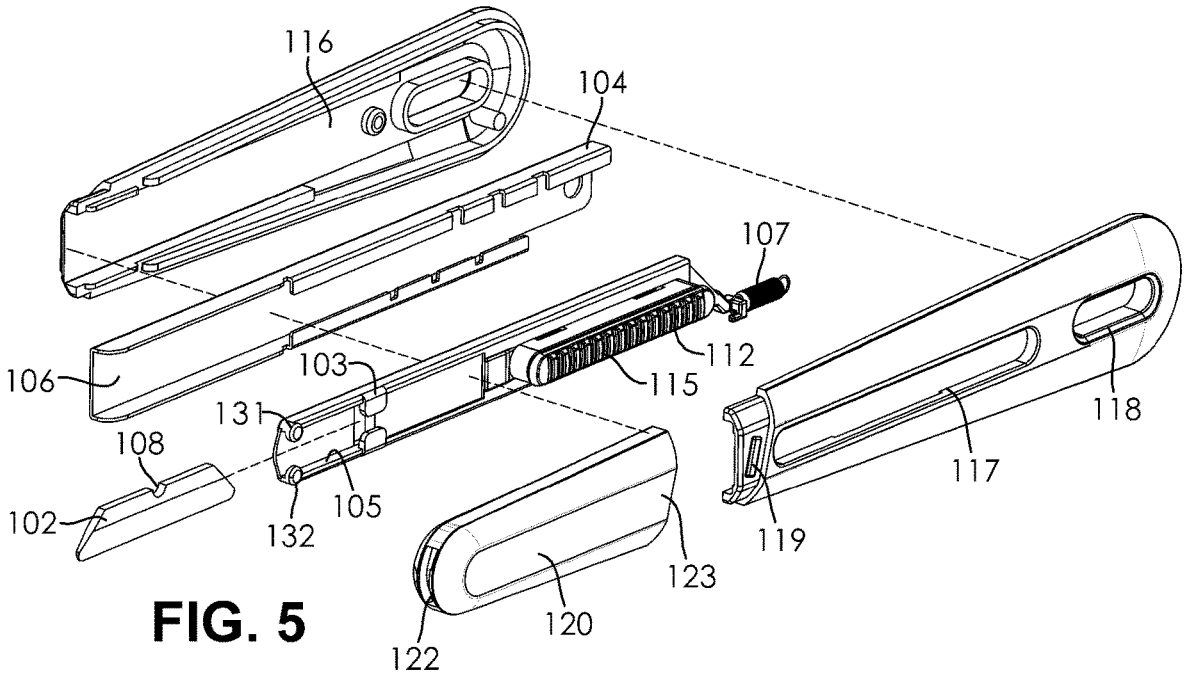
FIG. 5 is an exploded view of an exemplary automatically retractable cutting device in accordance with an embodiment of the present invention.
Figure 6:
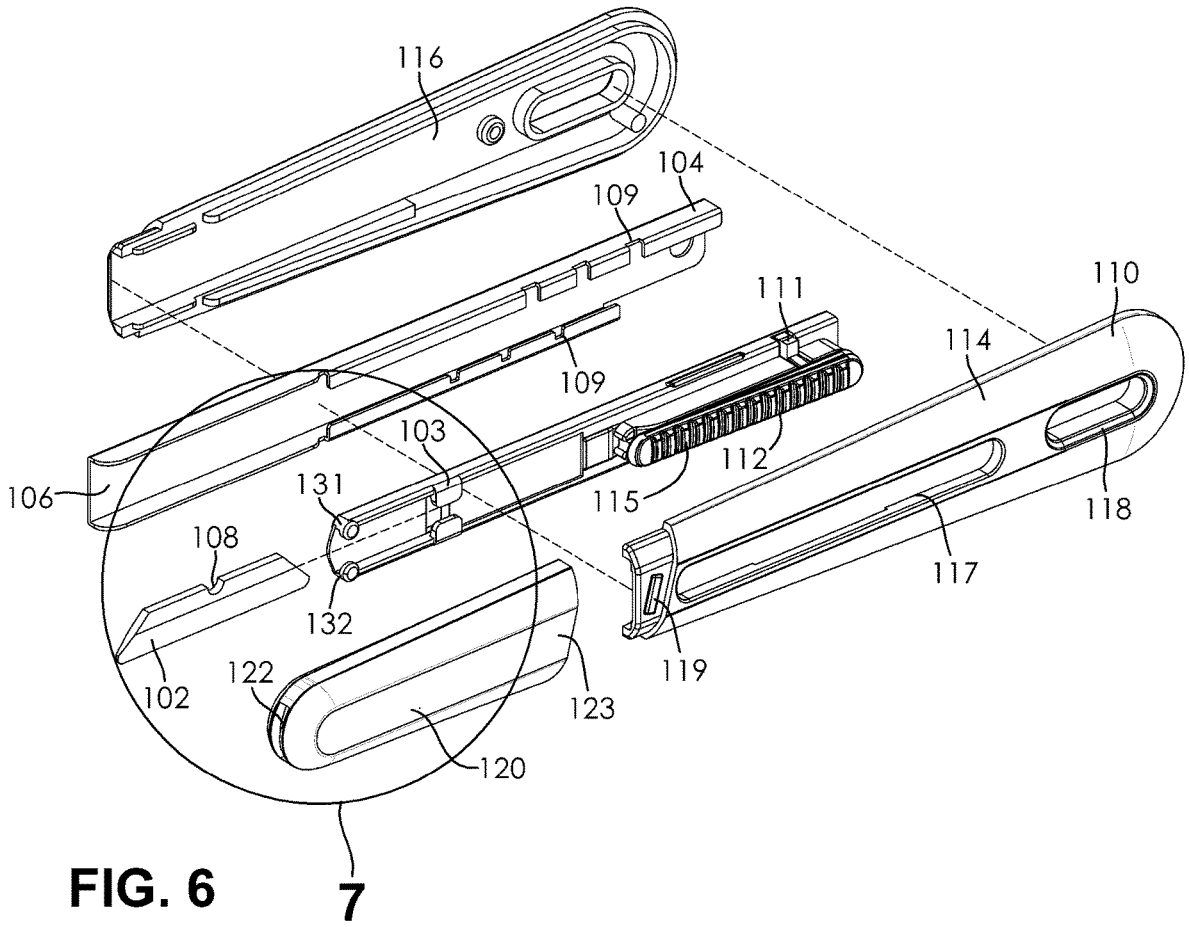
FIG. 6 is an exploded view of an exemplary manually extendable and retractable cutting device in accordance with an embodiment of the present invention.

FIG. 5 depicts an exploded view of an exemplary automatically retractable cutting device in accordance with an embodiment of the present invention and FIG. 6 depicts an exploded view of an exemplary manually extendable and retractable cutting device in accordance with an embodiment of the present invention. As shown in FIGS. 5 and 6, a cutting device 100 may comprise a housing 110, a cutting assembly 115, and a cover member 120. The cutting assembly 115 may comprise a blade carriage 103, a switch member 112, a blade carriage track 104, and a blade 102. The blade 102 may be removably disposable in the blade carriage 103. The blade carriage 103 may be movably disposed within the housing 110 or the blade carriage track 104. For example, the blade carriage 103 may be movably disposed within the blade carriage channel 106 of the blade carriage track 104, which may be configured to receive the blade carriage 103. As illustrated in FIG. 5, the blade carriage track 104 may include a plurality of wall portions. The wall portions of the blade carriage track 104 may act as ribs that fit around corresponding wall portions of the blade carriage 103. The interaction of corresponding wall portions of the blade carriage track 104 and wall portions of the blade carriage 103 may allow the blade carriage 103 to move (e.g., slide or translate in a forward or rearward direction along a length of cutting device 100) within the housing 110 or the blade carriage track 104 without rotation (e.g., the interaction of the wall portions of the blade carriage 103 and the blade carriage track 104 may substantially prevent a rotation of the blade carriage 103 as it moves within the housing 110). For example, the blade carriage 103 may move within the housing 110 between an extended position as illustrated in FIGS. 1-3 and a retracted position as illustrated in FIG. 4. For example, the blade carriage 103 may be moved to the retracted position, the extended position, or any position between the retracted position and the extended position.

As further shown in FIGS. 5 and 6, the blade carriage 103 may include a blade channel 105 formed as a cavity. The blade channel 105 may be configured with a spine or top side and a "belly" or bottom side and may be configured (e.g., shaped and/or sized) to receive at least a portion of the blade 102.

Figure 7:
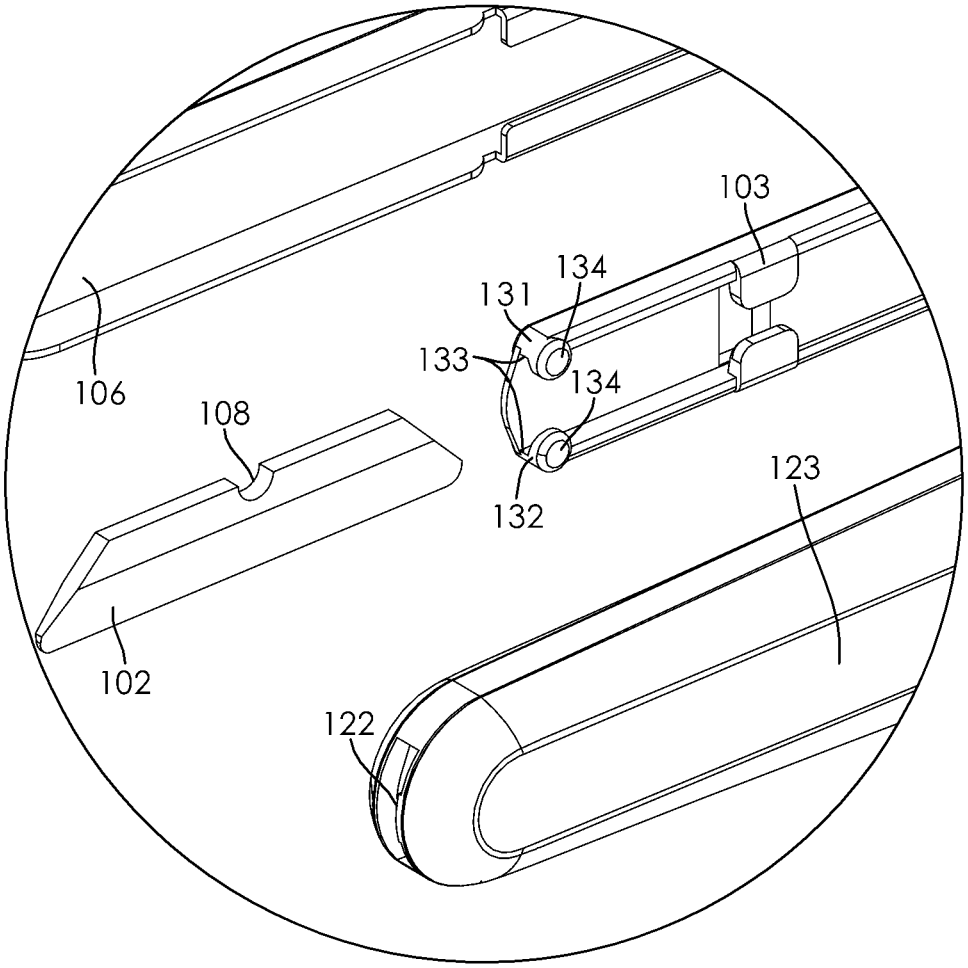
FIG. 7 is a zoomed in view of the exploded view shown in FIG. 6, showing an exemplary blade and blade channel in accordance with an embodiment of the present invention.

FIG. 7 depicts a zoomed in view of the exploded view shown in FIG. 6, demonstrating an exemplary blade and blade channel in accordance with an embodiment of the present invention. As shown in FIG. 7, the blade channel 105 may include one or more locking members, for example, a first locking member 131 and a second locking member 132. The locking members 131 and 132 may be configured to be received by a portion of blade 102 when blade 102 is received in the blade channel 105, for example, the locking members 131 and 132 may be configured to fit in a corresponding notch 108 in the blade 102. The blade channel 105 may securely retain blade 102 in such a manner so as to substantially prevent blade 102 from becoming dislodged or otherwise falling out of the blade carriage 103. The securing of blade 102 in the blade channel 105 of the blade carriage 103 may be a friction-fit attachment between blade 102 and wall portions of the blade channel 105, the first locking member 131, and/or the second locking member 132 of the blade channel 105. Each of the locking members 131 and 132 may be configured with one or more tab implements 134 and one or more indented portions 133 configured to engage or secure the cutting edge or "belly" of the blade 102. The locking members 131 and 132 may be configured to assist in releasably securing the blade 102 to the blade channel 105 in one of many available positions. For example, the notch 108 of the blade 102 may engage with locking member 131 or locking member 132 such that either the front or rear tip of the blade 102 may be disposed nearest the blade outlet slot 122 in the cover member 120. Also for example, each indented portion 133 of the locking members 131 and 132 may be configured to receive the cutting edge or "belly" side of the blade 102 such that the blade 102 may be retained within the blade channel 105 with the spine of the blade 102 corresponding or aligned with the spine of the blade channel 105. Alternatively, the orientation of the blade 102 may be flipped, such that the spine of the blade 102 corresponds or aligns with the "belly" or bottom side of the blade channel 105. Such a configuration of the blade channel 105 may assist a user in easily reorienting the blade 102 in the blade channel 105, for example, without the use of additional tools, to adjust the cutting device 100 such that it is compatible for both left-handed and right-handed users (e.g. ambidextrous).

As shown in the figures, the blade carriage 103 may include a switch member 112. The switch member 112 may be a member that extends or protrudes from the blade carriage 103. The switch member 112 may include a plurality of textured areas, for example, ridges, disposed on a surface of switch member 112. The switch member 112 may be received in aperture 117 of housing 110. The switch member 112 may be moved along a length of aperture 117. For example, a length of aperture 117 of housing 110 may define a range of movement through which switch member 112 may be moved (e.g., may define the range of movement through which the blade carriage 103 may be moved within housing 110). The switch member 112 may be an integral portion of the blade carriage 103. Alternatively, the switch member 112 may be a member that is attached to a portion of the blade carriage 103. A user of the cutting device 100 may interact with the switch member 112 to move the blade carriage 103 within the housing 110. The ridges may assist a user with maintaining positive contact (e.g., non-slipping contact) with the switch member 112 as the user pushes or pulls at the switch member 112.

As further shown in FIGS. 5 and 6, the cover member 120 may be configured to be removably attachable to housing 110. For example, the cover member 120 may be a cap that is attachable to housing 110. The cover member 120 may include a cavity formed by one or more interior wall portions of the cover member 120. Portions of the blade carriage 103, blade 102, and/or housing 110 may be received in the cavity formed in the cover member 120 (e.g., when cover member 120 is attached to housing 110). The cover member 120 may include a blade outlet slot 122 that may be configured to receive a portion of the blade 102 (e.g., when cover member 120 is attached to housing 110). The cover member 120 may also include one or more notches (not shown) (e.g., protruding portion notches) that are configured to receive one or more blade cover connector components or protruding portions 119 (e.g., when cover member 120 is attached to housing 110). As illustrated in FIGS. 5 and 6, the cover member 120 may have an end portion 123 that may be diagonal or slanted or relative to a lengthwise direction of the cover member 120. The end portion 123 may help in forming an attachment between the cover member 120 and a diagonal or slanted portion of housing 110 (e.g., when the protruding portions 119 are received in the cover member notches).

As shown in FIG. 5, the cutting assembly 115 may comprise a tension component 107. The tension component 107, for example, a spring, may be disposed between the blade carriage 103 and an internal wall of the housing 110. The tension component 107 may be configured to bias the blade carriage 103 towards the retracted blade position such that the blade 102 disposed in the blade channel 105 may be biased towards the interior of the housing 110. In some scenarios, if a force, for example, a forward force, greater than the biasing force applied by the tension component 107 is applied to the switch member 112 of the blade carriage 103, the blade carriage 103 may move forward such that the blade 102 disposed in the blade channel 105 may extend past the blade outlet slot 122 in the blade cover member. Moreover, if a force is released or not applied to the switch member 112 or the blade carriage 103 (or the force applied to the blade carriage 103 is lower than the biasing force applied by the tension component 107), the tension component 107 may direct the blade carriage 103 to automatically retract to return the blade 102 to its retracted position. This configuration of the cutting device 100 may provide a safety feature to the device, such that the blade 102 does not remain extended or exposed and likely to cause injury, for example, when the blade 102 is not in use by a user.

As shown in FIG. 6, the blade carriage track 104 may be disposed between the rear-half body shell 116 and the blade carriage 103. The blade carriage track may include a blade carriage channel 106. The blade carriage channel 106 may be a void formed in the blade carriage track 104 that creates a passage for the blade carriage 103 to move from a first position to a second position. The blade carriage channel 106 may define the movement boundary of the blade carriage 103 and may include one or more locking elements, for example, one or more slots 109 (e.g., a pair of slots substantially opposing one another) that are disposed along the blade carriage channel 106 configured to stabilize and secure the switch member 112 in a user selected position of a set of preselected positions defined by the location of the one or more slots 109. In some examples, one or more tab members 111 extending from switch member 112 may be configured to correspond to the size and orientation of one or more of slots 109 in the blade carriage channel such that when the tab members 111 of the switch member rest within the slots 109, the switch member 112, and the blade carriage 103 operably connected thereto, are reversibly and securely locked in the position corresponding to the position of the slots 109. This configuration may enable a user to manually retract and extend the blade 102, as desired by the user.

The exemplary cutting device 100 may be constructed from any suitable variety of durable materials. For example, some or most of the components of the exemplary cutting device 100 may be formed from plastic or a plastic composite material. Also for example, some or most of the components of the exemplary cutting device 100 may be formed from metal or metal alloy. Further for example, the exemplary cutting device 100 may include ceramic material. For example, cutting device 100 may be formed from plastic, plastic composite, metal, metal alloy, and/or ceramic materials. For example, housing 110 and/or cover member 120 may be formed partially or substantially entirely from plastic, plastic composite, metal, and/or metal alloy materials. For example, housing 110 and/or cover member 120 may be plastic or metal structural members. As described further below, cutting assembly 115 may include components formed from plastic, plastic composite, metal, and/or metal alloy materials and components formed from ceramic materials. Also for example, certain components of cutting device 100 may include specific materials based upon the application or function of a given component. For example, members of cutting device 100 designed to come into contact with a cutting surface and that may be subject to constant friction may include materials resistant to friction such as glass-filled nylon and/or polyamide plastic. For example, cutting device 100 may include any suitable materials for use in a cutting device such as, e.g., a box cutter, a utility knife, a seam ripper, or a precision knife.

The blade 102 may be any suitable blade or cutter for cutting of a material by cutting device 100. For example, the blade 102 may be formed from a ceramic material that is capable of withstanding extended use before becoming dull or unusable. For example, the blade 102 may be a ceramic blade. Also for example, the blade 102 may include ceramic materials such as Zirconium Oxide or any other suitable ceramic materials for use in a blade. For example, the blade 102 may be a ceramic blade that may be a hooked blade formed from Zirconium Oxide. Alternatively for example, the blade 102 may be a metal blade or a blade formed from any suitable material than can be used for cutting materials. The blade 102 may include rounded tips to reduce the chance of a user being cut unintentionally by the blade 102.

The exemplary disclosed device and method may provide an intuitively simple and safe technique for cutting materials and/or replacing blades of a cutting device. The exemplary disclosed device and method may be used in any application involving cutting materials safely. For example, the exemplary cutting device and method may be used in applications such as pen cutters, seam rippers, box cutters, utility knives, precision knives, and any other suitable application for cutting materials.

An exemplary operation of cutting device 100 will now be described. As illustrated in FIGS. 5 and 6, the housing 110 is provided including cover member 120. The cutting assembly 115 is disposed in housing 110. The blade 102 is removably disposed in the blade channel 105 of the blade carriage 103.

As illustrated in FIGS. 1-3, the cutting assembly 115 including the blade 102 disposed in the blade carriage 103 may be in an extended position. The switch member 112 may be disposed at a forward portion of the aperture 117 as illustrated in FIGS. 1-3 when the cutting assembly 115 is in the extended position.

In accordance with an exemplary usage scenario, the cutting assembly 115 may be moved from the extended position illustrated in FIGS. 1-3 to the retracted position illustrated in FIG. 4. A user may move the cutting assembly 115 by pushing switch member 112 of the blade carriage 103. For example, the cutting assembly 115 may be in the retracted position when one or more tabs 111 of the switch member 112 are received in a first pair of slots 109 of the blade carriage track 104 and the cutting assembly 115 may be in the extended position when one or more tabs 111 are received in a second pair of slots 109 of the blade carriage track 104. For example, a user may push on the switch member 112 to cause a tension components, for example, a spring or leaf spring in the switch member 112 to flex, allowing the one or more tabs of the switch member 112 to be removed from (e.g., disengaged from) a respective pair of slots 109. For example, a user may push on the switch member 112 to disengage the tabs 111 from one or more slots 109, and then push the switch member 112 to move the cutting assembly 115 to another position (e.g., to move cutting assembly 115 from one of the extended position, retracted position, or half-extended position to another one of those positions). It is also contemplated that the blade carriage track 104 may include additional slots 109 so that cutting assembly 115 may be disposed in additional positions (e.g., three-quarters extended). As illustrated in FIG. 4, the switch member 112 may be disposed at a rear portion of aperture 117 when the cutting assembly 115 is in the retracted position.

A user of cutting device 100 may attach the cover member 120 to the housing 110 when the cutting assembly 115 is in the retracted or extended positions. The cover member 120 may be pushed by a user onto the housing 110 until the blade cover connector components or protruding portions 119 of the housing 110 are received by the one or more notches (not shown) of the cover member 120.

In accordance with another exemplary usage scenario, the cutting assembly 115 may be moved from the retracted position illustrated in FIG. 4 to the extended position illustrated in FIGS. 1-3. A user may move the cutting assembly 115 by pushing switch member 112 of the cutting assembly 115. When the cutting assembly 115 is in the extended position, one or more tabs 111 of the switch member 112 may substantially block movement of the switch member 112, the blade carriage 103, and the blade 102 disposed therein. As illustrated in FIGS. 1-3, the switch member 112 may be disposed at a front portion of aperture 117 when the cutting assembly 115 is in the extended position.

It is contemplated that the cutting assembly 115 may be locked in the position illustrated in FIGS. 1-3. For example, the cutting assembly 115 may be lockable in a forward position so as to cause the blade 102 to remain extended out of the blade outlet slot 122 of the cover member 120. The cutting assembly 115 may be locked in the forward position by any suitable locking mechanism such as, for example, a friction fit locking mechanism, a latching mechanism, and/or a ratcheting mechanism.

It is also contemplated that the cutting assembly may automatically retract to the position illustrated in FIG. 4. For example, the tension component 107, for example, a spring, may be configured to bias the blade carriage 103 to retract such that the blade 102 disposed in the blade channel 105 of the blade carriage 103 may be biased towards the interior of the housing 110. In some scenarios, if a force greater than the biasing force applied by the tension component 107 is applied to the switch member 112 connected to the blade carriage 103, the blade carriage 103 may move forward such that the blade 102 disposed in the blade channel 105 may extend past the blade outlet slot 122 in the blade cover member 120. Moreover, if a force is released or not applied the switch member 112 or the blade carriage 103 (or the force applied to the blade carriage 103 is lower than the biasing force applied by the tension component 107), the tension component 107 may be configured to direct the blade carriage 103 to automatically retract to return the blade 102 to the retracted position shown in FIG. 4.

If desired, a user of the cutting device 100 may remove blade 102. For example, the blade 102 may be removed from the blade carriage 103 when the cover member 120 is removed to expose the blade carriage 103. For example, a user may replace a used blade 102 with a new blade 102 when the cover member 120 is removed from the housing 110. For example, a user of cutting device 100 may replace a relatively dull blade 102 that has been used many times for cutting material with a new blade 102. Also for example, a user may reorient the blade 102 in the blade channel 105 such that the spine of the blade 102 either aligns with or opposes the spine side of the blade channel 105 and may thus adjust the cutting device 100 such that it is compatible for both left-handed and right-handed uses (e.g. ambidextrous).

The exemplary disclosed cutting device and method may provide an intuitively simple device and technique for safely and easily replacing blades of the cutting device. The exemplary device may allow users unfamiliar with the device to quickly, easily, and safely replace the blades. The exemplary device and method may also provide a user with a cutting device having a blade that may be resistant to dulling and may be used for relatively long periods of time without replacing a blade. The exemplary device and method may provide an ergonomically efficient device and method that allows a user to avoid frustration in using a cutting device, including during replacement of the device blades.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a housing;

a carriage that is movably disposed in the housing, the carriage having a blade channel and being movable between a retracted position and an extended position;

a blade that is removably disposable in the carriage; and a cover member that is removably attachable to the housing;

wherein the blade channel comprises an upper channel and a lower channel and at least one pair of locking members adapted to releasably secure the blade in a first position wherein a top side of the blade aligns with the upper channel of the blade channel and a second position wherein a top side of the blade aligns with the lower channel of the blade channel;

wherein each locking member of said pair of locking members is disposed on an opposite side of the blade channel, and comprises one or more tab implements and one or more indented portions; and wherein at least one of the one or more tab implements is adapted to be releasably received in at least one blade notch, and at least one of the indented portions is adapted to selectively receive a portion of the cutting edge of the blade.

2. The cutting device of claim 1, wherein the cover member includes a blade outlet slot.

3. The cutting device of claim 1, wherein the cutting device is one of a pen cutter, seam ripper, a box cutter, a utility knife, or a precision knife.

4. A cutting device, comprising:

a housing that is a handle;

a blade carriage that is movably disposed in the housing, the blade carriage having a blade channel and being movable between a retracted position and an extended position;

a blade having one or more notches, the blade being removably disposable in the blade channel; and a blade cover having a blade outlet slot, the blade cover being removably attachable to the housing;

wherein the blade channel comprises an upper channel and a lower channel and at least two locking members comprising one or more tab implements and one or more indented portions, at least one of the one or more tab implements adapted to be releasably received in at least one blade notch, and at least one of the one or more indented portions adapted to selectively receive a portion of the cutting edge of the blade, wherein each locking member is configured to releasably secure the blade in a first position wherein a top side of the blade aligns with the upper channel of the blade channel and a second position wherein a top side of the blade aligns with the lower channel of the blade channel.

5. The cutting device of claim 4, wherein the blade carriage is configured to move at least between an extended position, wherein the blade extends past the blade outlet slot in the blade cover, and a retracted position, wherein the blade is disposed within the blade cover or housing.

6. The cutting device of claim 4, wherein the blade carriage is operably connected to a tension component configured to bias the blade carriage towards the retracted position.

7. The cutting device of claim 4, wherein the cutting device is one of a pen cutter, seam ripper, a box cutter, a utility knife, or a precision knife.

8. A cutting device, comprising:

a housing that is a handle;

a blade carriage that is movably disposed in the housing, the blade carriage having a blade channel with a top side opposing a bottom side and being movable between a retracted position and an extended position;

a blade having a top side with one or more notches disposed thereon opposing a bottom side formed as a cutting edge, the blade being removably disposable in the blade carriage;

a blade cover that is removably attachable to the housing;

wherein the blade channel comprises an upper channel and a lower channel and one or more pairs of locking members disposed on opposite sides of the blade channel, each locking member of the one or more pairs of locking members comprising one or more tab implements and one or more indented portions, at least one of the one or more tab implements adapted to be releasably received in at least one blade notch, and at least one of the one or more indented portions adapted to selectively receive a portion of the cutting edge of the blade; and wherein the locking members are configured to releasably secure the blade in a first position wherein the top side of the blade aligns with the upper channel of the blade channel and a second position wherein the top side of the blade aligns with the lower channel of the blade channel.

9. The cutting device of claim 8, wherein the blade includes ceramic material.

10. The cutting device of claim 8, wherein the cutting device is one of a pen cutter, seam ripper, a box cutter, a utility knife, or a precision knife.

11. The cutting device of claim 8, further comprising a switch member and a blade carriage track configured to permit and define movement of the blade carriage.

12. The cutting device of claim 11, wherein one or more slots are disposed along the blade carriage track configured to stabilize and secure the switch member in a user selected position of a set of preselected positions defined by the location of the one or more slots.

13. The cutting device of claim 8, wherein the housing includes an aperture configured to receive a string, a lanyard, or a keychain.

14. The cutting device of claim 8, wherein the configuration of the blade channel enables ambidextrous use of the cutting device.

* * * * *